US007122117B1

(12) United States Patent
Goldring et al.

(10) Patent No.: US 7,122,117 B1
(45) Date of Patent: Oct. 17, 2006

(54) SELF-CLEANING COMPOSITE DECK DRAIN

(75) Inventors: Jeffrey S. Goldring, Annapolis, MD (US); Daniel M. Bergen, Jr., Linthicum, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 117 days.

(21) Appl. No.: 10/975,125

(22) Filed: Oct. 28, 2004

Related U.S. Application Data

(60) Provisional application No. 60/515,696, filed on Oct. 31, 2003.

(51) Int. Cl.
*E03F 5/04* (2006.01)
*E03F 5/06* (2006.01)

(52) U.S. Cl. ..... 210/163; 4/286; 4/287; 114/343; 114/364; 210/164

(58) Field of Classification Search ..... 114/182, 114/343, 364; 4/286–292; 210/163–166
See application file for complete search history.

(56) References Cited

U.S. PATENT DOCUMENTS 2,320,903 A 6/1943 Archer
2,869,727 A * 1/1959 Howe ..... 210/429
3,042,210 A 7/1962 Hattori
3,173,442 A * 3/1965 McKillip ..... 137/247.23
3,481,632 A * 12/1969 Suess ..... 285/42
3,725,964 A 4/1973 Whitsett
4,462,123 A * 7/1984 Morris et al. ..... 4/286
4,910,811 A 3/1990 Izzi, Sr.
4,922,948 A * 5/1990 Van Dijk ..... 137/247.33
5,724,777 A 3/1998 Hubbard
6,537,446 B1 3/2003 Sanguinetti

OTHER PUBLICATIONS

Fiberbond Deck Drains Selection & Installation Guide, Fiberglas & Advanced Composite Piping System, Baton Rouge, Louisiana.
Sparta drawing dated Jun. 22, 2004.
Navy Drawing 80064-803-1385789 7 pages.
Composite Deck Drain Drawing publically disclosed Apr. 22, 2002 to Corrosion Engineering Services, Crystal City, VA.

* cited by examiner

*Primary Examiner*—Sherman Basinger
(74) *Attorney, Agent, or Firm*—Jacob Shuster

(57) ABSTRACT

A self-cleaning composite deck drain apparatus which includes a removable top part having a top grating surface for receiving waste liquid and a trap for catching particulate matter from the liquid at a lower end. The drain apparatus further includes a bottom part having a drainpipe within an annular chamber formed thereabout for receiving and holding the top part. Circumferentially spaced locking tabs are affixed to the edge of the top part below the grating surface thereof for reception within tab receivers in the bottom part when the top part is inserted into the chamber of the bottom part and turned for locking of the tabs within the tab receivers. The top part includes a threaded bore within which a valve is manually operable to open and close the drainpipe. The deck drain apparatus is made of composite plastic materials to resist corrosion.

25 Claims, 4 Drawing Sheets

SECTION A-A

FIG. 1A
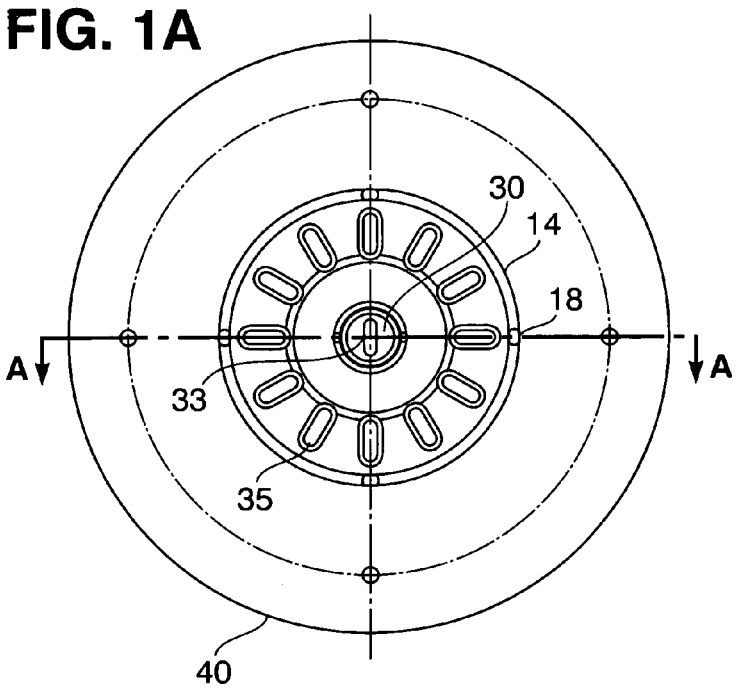
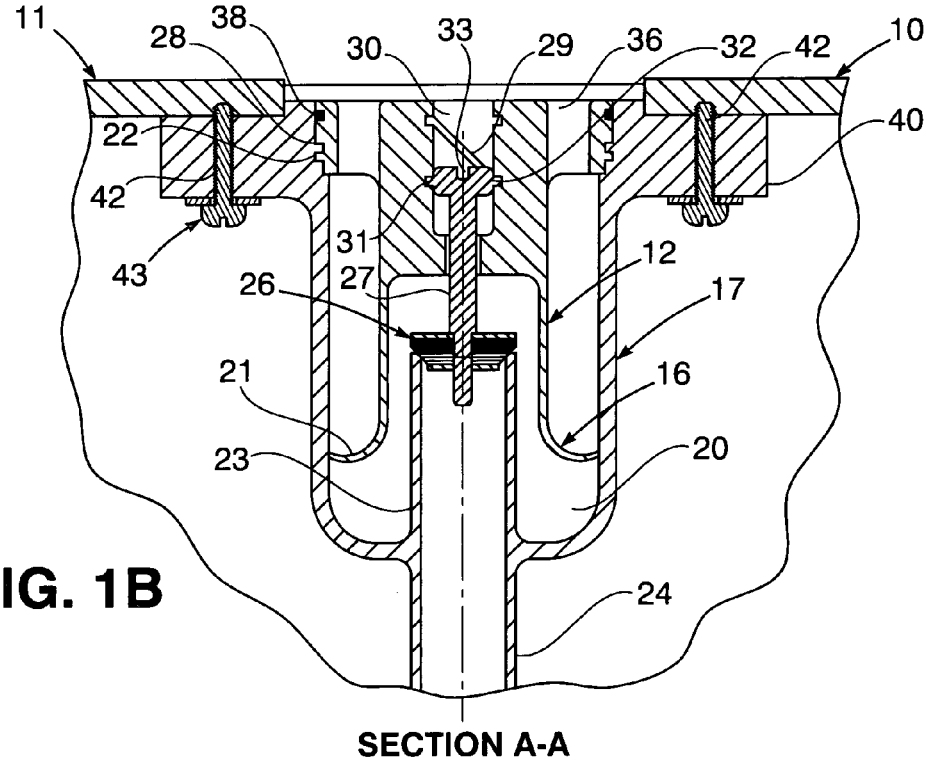
FIG. 1B

FIG. 3A
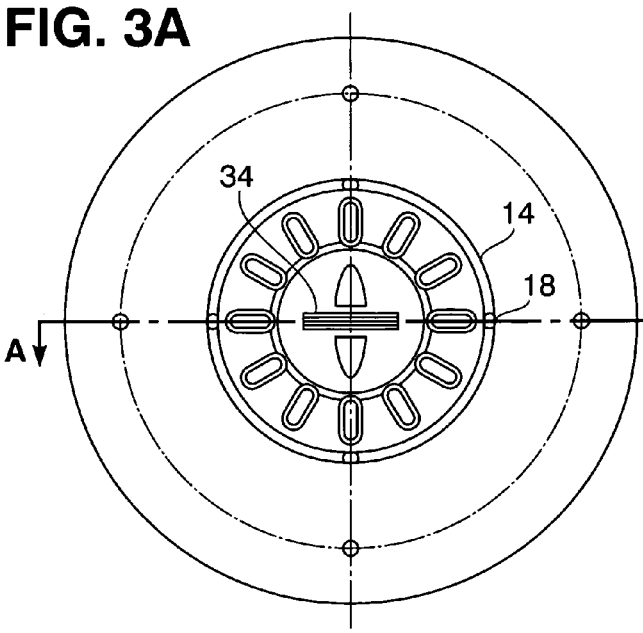
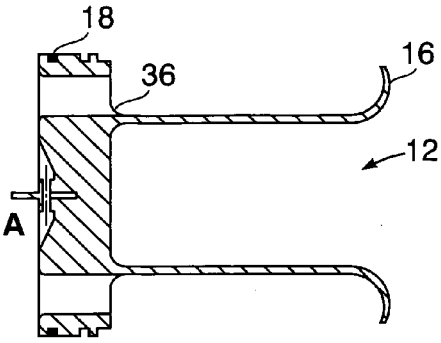
FIG. 3C
FIG. 3B
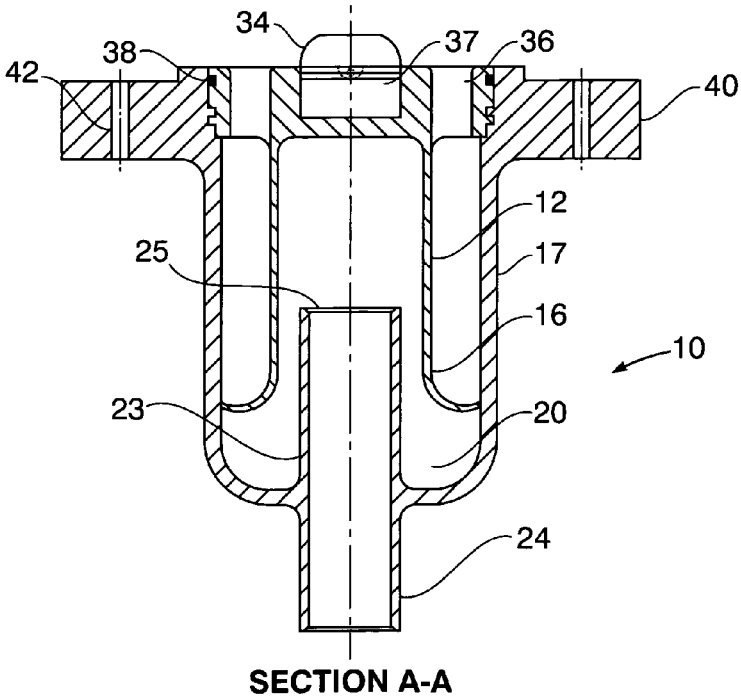

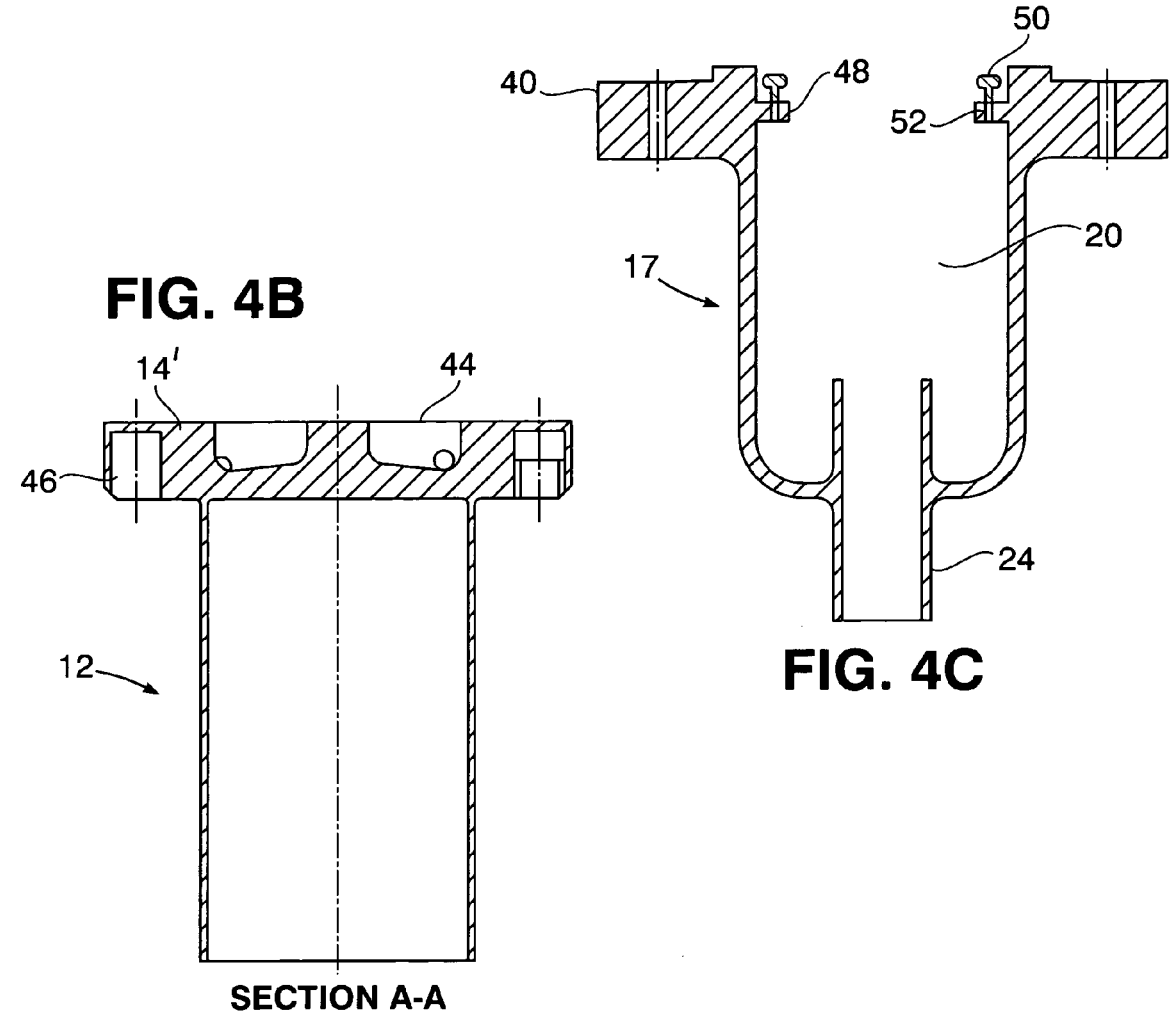
FIG. 4B
FIG. 4C
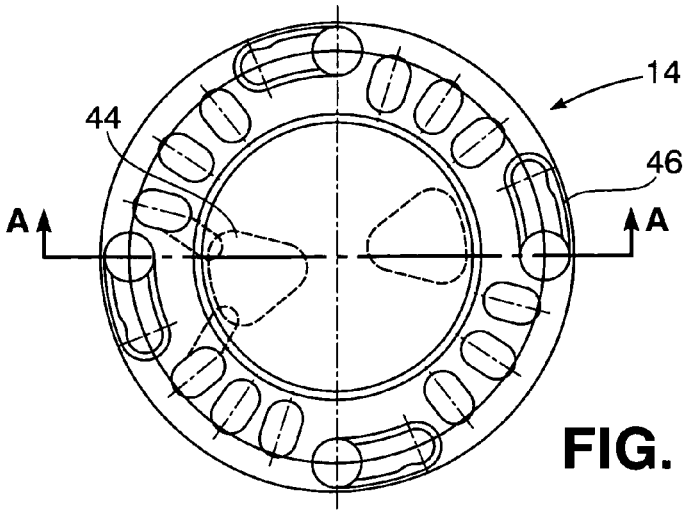
FIG. 4A

SELF-CLEANING COMPOSITE DECK DRAIN

CROSS-REFERENCE TO RELATED APPLICATION

This application claims the benefit of U.S. Provisional Application No. 60/515,696 filed Oct. 31, 2003, entitled "SELF-CLEANING COMPOSITE DECK DRAIN", incorporated herein by reference.

The present invention relates generally to apparatus for drainage of wastewater from surfaces such as a ship deck, with self cleaning facilities.

STATEMENT OF FEDERALLY SPONSORED RESEARCH AND DEVELOPMENT

The invention claimed and disclosed herein may be manufactured and used by, or on behalf of, the Government of the United States of America for government purposes without the payment of any royalties thereon or therefor.

BACKGROUND OF THE INVENTION

The present invention relates generally to deck drains, and more particularly to a self-cleaning deck drain assembly that includes an integral valve and that is substantially made of composite plastic material. Deck drains are known and have been used to drain wastewater and other liquids from decks, floors and other such planar surfaces. For instance, deck drains are widely used aboard naval ships to facilitate the expedient drainage of wastewater, seawater and other liquids from shipboard decks, particularly passageways, heads, scullery, galley, machinery spaces as well as decks exposed to the weather and seas.

United States Navy Standard Drawing 80064-803-138579, Fittings, Deck Drains (Rev. G) (1987) illustrates several types of past deck drains that have been used aboard United States Navy ships. These and other such deck drains historically have been a source of procurement and maintenance expense to the United States Navy. A disadvantage of past deck drains is that they are prone to corrosion and require substantial maintenance to keep in good working condition. The materials used to fabricate past deck drains are susceptible to cosmetic and structural corrosion caused by extended exposure to the marine environment.

For instance, Navy Drawing 80064-803-1385789 further illustrates that past deck drains have been made of various combinations of cast bronze, cast steel, aluminum and copper-nickel. While these metals resist corrosion to some degree, they are nevertheless subject to the corrosive effects caused by long exposure to weather, seas and chemical entrained in drainage liquids. Past deck drains also suffer from galvanic corrosion (electrolysis) resulting from using drain components of dissimilar metals, for example assembling the deck drains using steel, stainless steel, aluminum, monel, bronze or brass screws. Past deck drains are often assembled using special alloy screws that are prone to either getting lost during maintenance, corroding, or both.

A further disadvantage of past deck drains is that they are prone to getting internally obstructed with small particulate matter, particularly because it is often time-consuming and difficult for the ship's crew to disassemble the drains for cleaning. Past deck drains require considerable expertise and time to disassemble, typically requiring the use of hand tools and detailed maintenance procedures to ensure that the drain remains clean and corrosion-free. For example, some past deck drains must be partly or even completely removed from the deck to enable particulate matter to be removed from internals of the deck drain. Other past deck drains are readily removed from the deck for cleaning, yet are susceptible to coming loose from the deck during normal operation due to the impact of foot or vehicle traffic on the drain grating. Past deck drains, particularly deck drain screws, bolts or other fasteners, are often lost because they are swept into the drain. Critical small parts of past deck drains often become loosened and fall out due to the repeated low frequency vibration of the deck caused by, for instance, the effect of the operation of the ship's engines or other equipment upon the structure, driving the decking surface.

Further disadvantageously, past deck drains are expensive to install and normally require that that deck drain assembly be welded into or to the underside of the deck using expensive welding procedures. Past deck drains are also expensive because they are typically made out of exotic metallic alloys in an attempt to better resist corrosion, yet that often require special welding and assembly techniques to install, repair and replace as the surrounding multiple layers of corrosion protection and surface finish around the drain must be restored.

Backflow of waste liquids and gases is particularly of concern aboard naval ships because backflow may include flooding seawater or fire combustion gases when the ship sustains damage by accident or combat. Combustion gases from shipboard fires, or seawater admitted through damage to the ship's hull, can disastrously spread throughout the ship by passing through the deck drains of the ship's drainage system. Indeed, past deck drains, notably those made of bronze or aluminum are particularly susceptible to damage or even outright combustion caused by shipboard fires. Thus, past deck drains represent a potential source of danger to naval ships because they are prone to spreading seawater, chemicals, flammable liquids, gases and fire combustion gases to flood throughout the interior of the ship during combat, accident or fire.

Information relevant to attempts to address these problems can be found in U.S. Pat. Nos. 2,320,903, 3,042,210, 3,725,964, 4,910,811, 5,724,777 and 6,537,446. However, each one of these references suffers from one or more of the following disadvantages:

U.S. Pat. No. 2,320,903, issued to Archer on Jun. 1, 1943, discloses a scupper valve installed in an opening of a ship's hull and operable to drain water and other liquids from the deck of the ship to the sea. Archer, however, does not disclose a valve disposed within a removable top part and operable to close the outlet opening and thereby prevent liquid from draining from the drain. Archer does not disclose a valve actuator substantially disclosed within a grating and operable to open and close a drain.

U.S. Pat. No. 3,042,210, issued to Hattori on Jul. 3, 1962, discloses a trap that is made detachable from a floor drain so that accumulated mud, dust, and the like in the trap may be easily removed for cleaning. Hattori, however, does not disclose a plurality of circumferentially spaced locking tabs affixed to the edge of a grating, nor a plurality of tab receivers formed in a housing to lock the trap within the outer housing of the drain. Hattori does not disclose a valve disposed within the trap apparatus and operable to close a drainpipe, thereby preventing liquid draining or flooding from the drain. Hattori does not disclose a seal on the drain apparatus to prevent the escape of gases from the drain. Hattori does not disclose that the trap may be made of fire-resistant, low-smoke, non-corroding composite material.

U.S. Pat. No. 3,725,964, issued to Whitsett on Apr. 10, 1973, discloses a trap for a kitchen sink drain that can be lifted out of the receptacle with which it is used for cleaning purposes. Whitsett, however, does not disclose a plurality of circumferentially spaced locking tabs affixed to the edge of a grating, nor a plurality of tab receivers formed in a housing to lock the trap within the housing tube. Whitsett does not disclose a valve disposed within the trap and operable to a drainpipe, thereby preventing liquid draining from the drain. Whitsett does not disclose that the trap may be made of fire-resistant, low-smoke, non-corroding composite material.

U.S. Pat. No. 4,910,811, issued to Izzi, Sr. on Mar. 27, 1990, discloses an all-plastic floor drain, including a rigid plastic connector body and a rigid plastic strainer plate that is received in an annular recess in the connector body. Izzi, Sr., however, does not disclose that the floor drain may be made of fire-resistant, low-smoke, non-corroding composite material.

U.S. Pat. No. 5,724,777, issued to Hubbard on Mar. 10, 1998, discloses a roof drain arrangement and method for sealing a space between an existing drain opening, the roof drain arrangement, and a new roof membrane. Hubbard, however, does not disclose that the roof drain arrangement may be sealed using polysuldife or polyurethane adhesives.

U.S. Pat. No. 6,537,446, issued to Sanguinetti on Mar. 25, 2003, discloses an apparatus and system for removing debris and contaminants from water passing through a storm drain. Sanguinetti, however, does not disclose a plurality of circumferentially spaced locking tabs affixed to the edge of the debris trap, nor a plurality of tab receivers formed in the body portion to lock the debris trap within the body portion. Sanguinetti does not disclose a valve disposed within the apparatus or system and operable to prevent liquid draining from the drain. Sanguinetti does not disclose that the body potion is adhesively affixed to the storm drain. Sanguinetti does not disclose that the apparatus may be made of fire-resistant, low-smoke, non-corroding composite material.

For the foregoing reasons there is a need for a self-cleaning deck surface drain, that is substantially fire and corrosion-resistant.

SUMMARY OF THE INVENTION

Pursuant to the present invention, a deck drain is provided which satisfies the need for a self-cleaning composite deck drain that is easily disassembled and assembled for cleaning. The present invention is further directed to a deck drain wherein the top part and the bottom part of the deck drain may be conveniently locked together when the deck drain is assembled. The present invention is also directed to a deck drain that includes a valve that is manually operable to close the drainpipe of the deck drain to prevent backflow of waste liquid, odors, floodwater, chemicals, flammable liquids, gases and fire combustion gases. The deck drain of the present invention is substantially made of composite materials to reduce maintenance and improve the ability of the deck drain to resist damage from the environment and fire.

Therefore, an object of the present invention is to provide a deck drain that is easily disassembled and disassembled for cleaning.

The present invention overcomes problems by providing a self-cleaning composite deck drain assembly. The deck drain assembly of the present invention includes a conveniently removable top part that has a grating for receiving drainage liquid at one end and a debris trap for catching debris from the liquid at a second end. The deck drain apparatus further includes a bottom part attached to a drainpipe and defining an annular chamber for receiving and securely holding the top part. Several circumferentially spaced locking tabs are affixed to the edge of the grating and readily engage with tab receivers of the bottom part to thereby securely lock the parts together when the user inserts the top part into the bottom part. The top and bottom parts may be expeditiously locked and unlocked from each other by the user using a handle or finger holes in the top part to turn the top part about its longitudinal axis when the top part is inserted within the bottom part.

The top part of the present invention includes a threaded bore with a valve integrally disposed therein. The valve includes a valve actuator, so that the valve is thereby manually operable to open and close the drainpipe, thus preventing backflow of waste liquid, floodwater and fire combustion gases into the deck drain. The deck drain assembly is fabricated of fiber or glass-reinforced plastic materials chosen to reduce corrosion and resist fire and smoke emission when burned, thereby greatly reduces deck drain maintenance requirements and combustibility in the event of shipboard fire.

An object of the present invention is also to provide a deck drain that has a removable top part that may be securely locked within a bottom part when the deck drain is reassembled after cleaning.

Another object of the present invention is to provide a deck drain that includes an integral valve that is manually operable to close the drainpipe of the deck drain.

A further object of the present invention is to provide a deck drain that is substantially made of composite materials that resist the corrosive effects of the environment and damage from fire. The composite materials are selected to greatly reduce the amount of periodic maintenance that must be performed to maintain the deck drain in good working condition.

Still another object of the present invention is to provide a deck drain that is easily affixed to the a deck by the use of adhesives and mechanical fasteners, thus minimizing the need for welding and other such potentially flammable processes to install the deck drain in the deck structure.

According to the present invention, the foregoing and other objects and advantages are attained by a deck drain apparatus comprising a drain suitable for draining liquid from a deck, wherein the drain includes a top part with axially opposed ends. The top part includes a grating that has an edge and is disposed at the first end the top part. The grating is configured to receive water and other liquids draining from the deck and into the deck drain. A trap is disposed at the second end of the top part to catch debris entrained in liquid received into the drain. There are several locking tabs circumferentially spaced about and affixed to the edge of the grating of the top part. The deck drain also includes a bottom part that defines an annular chamber for holding the top part. Several tab receivers are formed within the annular chamber of the bottom part. The tab receivers of the bottom part engage with the locking tabs of the top part to lock the top part within the annular chamber of the bottom part. A drainpipe is affixed to the bottom part for draining liquid from the annular chamber and out of the deck drain. A valve is disposed within the top part of the drain. The valve is operable to close the drainpipe and prevent liquid from draining out of the drain or flooding from the drain.

In accordance with another aspect of the present invention, each of the tab receivers of the bottom part further include a tab groove to permit locking the top and the bottom parts together. The top and the bottom parts are locked together by a user turning the locking tabs of the top part within the tab grooves of the bottom part and about the longitudinal axis of the top part.

On other aspect of the present invention is that the top part of the drain includes a bore for threadably engaging the valve within the top part.

A further aspect of the present invention is that the valve includes a valve actuator that is substantially disposed within the grating of the top part and is manually operable to close the drainpipe of the bottom part.

In yet another aspect of the present invention, the grating further includes handle or finger hole means for a user to manually remove the top part from the bottom part.

An aspect of the present invention is that the grating further includes at least one baffle for channeling liquid into the trap of the top part.

Still another aspect of the present invention is that the top part further includes at least one seal disposed on the top part to prevent the escape of waste gases from the drain when the bottom part and the top part are locked together.

In accord with an additional aspect, the bottom part further includes a flange for attaching the drain to the deck.

Another aspect of the present invention is that the flange further includes several flange openings suitable for attaching the drain to the deck by bolting or by welded threaded studs.

One other aspect of the present invention is that the flange may be adhesively affixed to the deck.

By the present invention, a user may conveniently remove the top part to clean the trap therein of small particulate matter that would otherwise potentially enter and obstruct the drainpipe. The trap is easily cleaned, without the need for time-consuming and expensive disassembly of the entire deck drain structure. The top and bottom parts of the present invention may be quickly and securely locked together after such cleaning by inserting the top part into the bottom part and turning the top part to engage the locking tabs of the top part with the tab grooves of the bottom part.

The valve of the top part of the present invention is manually operable to conveniently open and close the drainpipe, thus providing dependable, convenient means for closing the drainpipe against-backflow of waste liquid, odors, floodwater and fire combustion gases into the deck drain.

A further aspect of the present invention is that adhesive may be selected from the group consisting of epoxy, polysulfide, polyurethane and methyl methacrylate adhesives or the general category of adhesive-sealant.

An aspect of the present invention is that the drain may be made of composite plastic material to improve the ability of the drain to resist damage.

The deck drain apparatus of the present invention, by using a removable top part, enables a user to easily remove the top part from the bottom part of the deck drain and clean the trap of small particulate matter trapped therein. After such cleaning, the top and bottom parts of the present invention may be quickly and securely locked back together by inserting the top part into the bottom part and turning the top part about its longitudinal axis, thereby engaging the locking tabs with the tab grooves of the bottom part. As described by the present invention, the valve of the top part is manually operable to enable the user to conveniently close the drainpipe, thus providing a secure means for closing the drain against backflow of waste liquid, odors, floodwater, chemicals, flammable liquids, gases and fire combustion gases. The present invention is made of composite plastic material to reduce corrosion and maintenance, and to make the deck drain apparatus significantly resistant to the destructive effects of heat and smoke from fire.

BRIEF DESCRIPTION OF THE DRAWINGS

A more complete appreciation of the invention and many of its attendant advantages will be readily appreciated as the same becomes better understood by reference to the following detailed description when considered in connection with the accompanying drawing wherein:

FIG. 1(A) shows a top plan view of the deck drain assembly in accordance with the present invention;

FIG. 1(B) shows a cross-sectional view of the deck drain assembly taken along section line A—A of FIG. 1(A) in accordance with the present invention;

FIG. 3(A) shows a top plan view of the deck drain assembly in accordance with an alternative embodiment of the present invention;

FIG. 3(B) shows a cross-sectional view of the deck drain assembly taken along section line A—A of FIG. 3(A) in accordance with the alternative embodiment shown in FIG. 3(A);

FIG. 3(C) shows a cross-sectional view of the top part of the deck drain assembly in accordance with an alternative embodiment of the present invention;

FIG. 4(A) shows a top plan view of the top part of the deck drain assembly in accordance with an alternative embodiment of the present invention;

FIG. 4(B) shows a cross-sectional view of the top part of the deck drain assembly taken along line A—A of FIG. 4(A) in accordance with an alternative embodiment of the present invention; and FIG. 4(C) shows a cross-sectional view of the bottom part of the deck drain assembly in accordance with an alternative embodiment of the present invention.

DETAILED DESCRIPTION OF THE INVENTION

Figure 2:
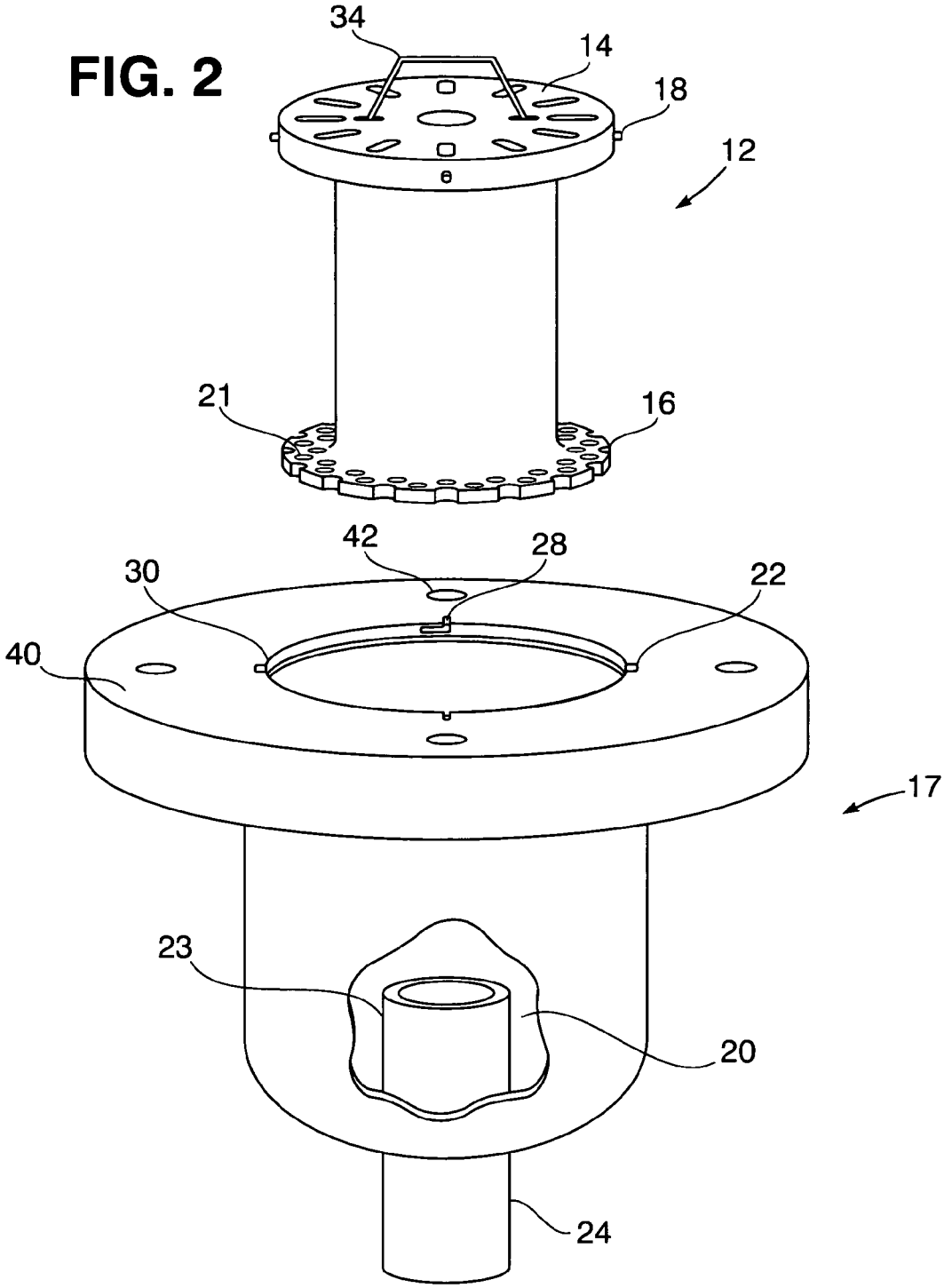
FIG. 2 shows an exploded perspective view of the top and the bottom parts of the deck drain assembly as shown in FIGS. 1(A) and 1(B) in accordance with the present invention.

As shown in FIGS. 1(A–B) and in FIG. 2, a deck drain 10 attached to a sea vessel deck 11, the drain 10 including a top part 12 and a bottom part 17. A grating 14 is disposed at a first end of the top part 12, and a trap 16 is disposed at a second end of the top part 12. The top part 12 further includes a plurality of locking tabs 18 affixed to another circular rim edge of grating 14. The top part 12 is fitted into an annular chamber 20 formed with the bottom part 17 of the drain 10. The bottom part 17 has a plurality of tab receivers 22 suitable for receiving the locking tabs 18 of the top part 12. The top part 12 and the bottom part 17 are locked and unlocked together by using a handle 34 as shown in FIGS. 3(A) and 3(B) to turn the top part 12 about its longitudinal axis to thereby engage and disengage the locking tabs 18 with the tab receivers 22 formed by tab grooves 28. The handle 34 may also be used to remove the top part 12 from the annular chamber 20 within the bottom part 17. The top part 12 further includes a valve 26 as shown in FIG. 1(B) disposed within a bore 30. The valve 26 is manually operable to open and close a drainpipe 23 in the bottom part 17. The bottom part 17 also includes a flange 40 that has a plurality of flange openings 42 formed therein. The flange 40 facilitate bolting and adhesively affixing of the deck drain 10 to the underside of a deck.

FIGS. 1(A–B) respectively show top plan and cross-sectional views of the preferred embodiment of the present invention. Referring further to FIGS. 1(A–B), the grating 14 includes a plurality of through openings 35 that are distributed over the surface of the grating 14. In the preferred embodiment, the grating 14 is generally circular in shape, but those skilled in the art will appreciate that the grating 14 may be shaped however best facilitates draining excess liquids from the deck and fitting the deck drain 10 within the confines of the surrounding deck structure.

The through openings 35 communicate with a plurality of baffles 36 to permit the passage therethrough of liquids and small particulate materials, but to prevent the passage therethrough of larger particles that may otherwise grossly obstruct the deck drain 10. The trap 16 has numerous perforations 21 formed therein to likewise permit the passage of liquids, but to prevent the passage of small particulate matter that is otherwise small enough to pass through the grating 14. Thus, the grating 14 and the trap 16 together act to prevent, respectively, large and small particulate matter from entering and potentially obstructing the drainpipe 23.

FIG. 2 shows an exploded perspective view of the top and bottom parts of the preferred embodiment of the present invention. FIG. 2 further shows the top part 12 removed from the bottom part 17 and schematically illustrates that the grating 14 has a plurality of the locking tabs 18 that are integrally formed with and circumferentially spaced about the edge of the grating 14. The bottom part 17 includes a corresponding plurality of tab receivers 22 and tab grooves 28, each being formed within the surface of the bottom part 17 at the upper axial end of the annular chamber 20.

The top part 12 and the bottom part 17 are locked together by inserting the top part 12 into the annular chamber 20 of the bottom part 17 to thereby engage each of the locking tabs 18 with a corresponding one of the tab receivers 22. The top part 12 is then turned clockwise about its longitudinal axis through the handle 34 to thereby frictionally engage each of the locking tabs 18 within a corresponding one of the tab grooves 28. The locking tabs 18 and the tab grooves 28 frictionally cooperate to securely lock the top part 12 into axial and radial position within the annular chamber 20 of the bottom part 17.

FIG. 1(B) shows the top part 12 locked within the annular chamber 20 of the bottom part 17. When the top and the bottom parts are so locked together, the edge of the grating 14 closely abuts the surface of annular chamber 20, thereby substantially preventing the flow of liquid into any space remaining between the edge and the surface of the annular chamber 20. The top part 12, however, is also provided with a seal 38 disposed about the circumference of the grating 14 functioning to provide a watertight barrier to prevent liquid from draining into the annular chamber 20 from the edge of the grating 14. The seal 38 also functions to prevent particulate matter from entering the edge of the grating 14 and thereafter obstructing or clogging the tab receivers 22 or the tab grooves 28 of the bottom part 17.

The seal 38 preferably is made of corrosion-resistant neoprene, Buna-N (nitrile), butyl, polyurethane, natural rubber or any other elastic gasket material that is chemically compatible with United States Navy JP4 MILJ-5624 military aviation fuel, and that facilitates easy removal and replacement of the seal 38 during routine maintenance. FIG. 1(B) discloses one seal 38. However, those skilled in the art will appreciate that several seals may be used. For instance, several seals may be disposed parallel to each other between the grating 14 and the tab receivers 22 and the tab grooves 28, thus providing several barriers to particulate matter entering the deck drain 10 assembly along the edge of the grating 14.

With further reference to FIG. 2, a handle 34 is pivotally disposed upon the grating 14. The handle 34 is configured so that it may be disposed in substantially parallel contact with the surface of the grating 14 when not being used. In use, the handle 34 is pivoted to a position approximately normal to the surface of the grating 14. The handle 34 thereafter is used to turn the top part 12 about its longitudinal axis. The top part 12 is locked to the bottom part 17 by using the handle 34 to turn top part 12 clockwise about its longitudinal axis (about ⅛ of a complete turn) to thereby engage each of the locking tabs 18 within a corresponding one of the tab grooves 28. The top part 12 is unlocked from the bottom part 17 by reversing the aforementioned process.

Thus, the handle 34 functions to turn the top part 12 into locking or unlocking engagement with the bottom part 17. FIG. 2 further illustrates that the handle 34 is U-shaped and centrally disposed upon the grating 14, but those skilled in the art will appreciate that the handle 34 may be configured in any shape and position upon the grating 14, as functionally or structurally necessitated by the required use.

Alternatively, handle 34 may be replaced by finger holes that are integrally formed in a surface of top part 12. The finger holes are configured to permit a user to insert her fingers into the finger holes and thereby lock and unlock top part 12 from bottom part 17 by turning top part 12 clockwise or counterclockwise about its longitudinal axis. Preferably, the finger holes are shaped to enable a user to lift top part 12 clear of bottom part 17 without the use of tools or other devices. Further, the finger holes may be configured to facilitate the passage of liquids and particulate through deck drain 10, thus minimizing standing liquid or collection of debris in the surrounding deck structure and obstructively upon grating 14.

After the top part 12 is securely locked with the bottom part 17, it may be desired to remove the top part 12, for example to clean particulate debris from the trap 16. To accomplish this, the top part 12 is removed from the annular chamber 20 by using the handle 34 to turn the top part 12 counterclockwise about its longitudinal axis to disengage the locking tabs 18 from within the tab grooves 28. The top part 12 is further disengaged from the tab receivers 22 by using the handle 34 to lift the top part 12 out and free from the annular chamber 20. Thus, the handle 34 is used to effectuate locking, unlocking and removing the top part 12 from the bottom part 17.

FIGS. 1(A–B) shows that a bore 30 is preferably formed about the center longitudinal axis of the top part 12. The bore 30 is internally molded with helical grooves 29 and receives the valve 26 therein. The valve 26 has a stem 27 with a valve actuator 32 at an upper end thereof. Preferably, the valve actuator 32 on the stem 27 has an outer tabs 31 externally received within the corresponding internal helical grooves 29 of the bore 30. The valve actuator 32 is manually operable by a tool received in a slot 33 therein to turn the stem 27 with the actuator 32 engaged within the internal grooves 29 of the bore 30 to thereby axially move the valve 26 into seating contact with a drainpipe 23 as shown in FIG. 1(B). The valve actuator 32 is similarly operable to axially move the valve 26 away from seating contact with the drainpipe 23. Accordingly, the valve actuator 32, by helically turning the stem 27 within bore 30, functions to open and close the drainpipe 23. This, in turn, blocks or unblocks the flow of waste liquids, odors and other gases from the grating 14 into the drainpipe 23.

FIG. 1(B) discloses that the valve actuator 32 includes a notch 33, formed within the surface of the valve actuator 32 and visibly disposed with the center portion of the grating 14. The notch 33 is suitable for receiving the bladed end of a conventional screwdriver or similar hand tool. By use of the screwdriver, the notch 33 may be manually turned, clockwise or counterclockwise about the longitudinal axis of the top part 12, thereby moving the stem 27 within the bore 30. As disclosed supra, this, in turn, acts to move the valve 26 towards or away from seating contact with the drainpipe 23. Thus, the notch 33 enables a user to use a hand tool to engage or disengage the valve 26 into seating contact with the drainpipe 23.

Also disclosed supra, preferably the stem 27 is axially disposed within the bore 30 so that the external tabs 31 of stem 27 threadably engage the corresponding internal grooves 29 of the bore 30. Alternatively, however, those skilled in the art will appreciate that the stem 27 may be frictionally, hydraulically or otherwise disposed within the bore 30 in any manner that enables a user to move the valve 26 towards or away from seating contact with the drainpipe 23. In these and other such alternative configurations, the surface of the bore 30 will accordingly be formed to frictionally, hydraulically or otherwise receive the stem 27 therein.

The drainpipe 23 is disclosed as integrally formed as part of the bottom part 17. The drainpipe 23 extends axially within the annular chamber 20 and distally from an end of the bottom part 17 to form a drain nipple 24. The drain nipple 24 is attachable to piping of a drainage system in any conventional manner. For instance, the drain nipple 24 may be threaded, swaged, adhesively bonded or frictionally engaged to the piping of a drainage system in any manner that effectuates a liquid-tight seal between the drain nipple 24 and the connector of the piping of the drainage system.

Referring again to FIG. 2, the bottom part 17 includes a flange 40, circular shaped in the preferred embodiment, and having the annular chamber 20 centrally formed therein. The flange 40 includes a plurality of circumferentially spaced flange openings 42, preferably that are internally threaded or otherwise adapted for receiving conventional bolts, screws, pins, studs or similar fasteners 43. The flange 40 may be secured to the underside of a deck 11 by passing the bolt 43 through each of the flange openings 42 and securing the bolts within a complementary-aligned bolthole in the deck 11. As further disclosed infra, the flange 40 may also be secured to the underside of a deck 11 by adhesives and by studs attached to the underside of the deck 11. In either of these methods, however, the flange 40 and the flange openings 42 function together to provide means for mechanically attaching the deck drain 10 to the underside of the deck 11.

FIGS. 3(A–C) respectively show top plan and cross-sectional views of an alternative embodiment of the present invention. In contrast to the preferred embodiment of the present invention disclosed supra, the top part 12 of this alternative embodiment of the present invention does not include a valve disposed within the top part 12 and operable to open and close the drainpipe 23. The top part 12 and the bottom part 17, however, are locked and unlocked together in the same method described supra, and the grating 14, the trap 16, and the seal 38 of the top part 12 are the same as in the preferred embodiment of the present invention.

FIG. 3(C) shows that in this alternative embodiment of the present invention, the handle 34 is disposed within a recess 37 of the grating 14, thereby ensuring that the handle 34 does not protrude above the surface of the grating 14 when the handle 34 is not in use. As with preferred embodiment of the present invention disclosed supra, the handle 34 may be pivoted to a position substantially normal to the surface of the grating 14 and thereafter be used to turn top part 12 about its longitudinal axis.

FIG. 3(B) furthermore shows that in this alternative embodiment of the present invention, the top part 14 includes a screen 25 affixed to one end of the drainpipe 23. The screen 25 is made of any corrosion-resistant material such as composite or plastic, but may also be made of stainless steel, copper-nickel alloy or galvanized metal, and functions to block any fine particulate matter that otherwise passes through the grating 14 and trap 16 from entering and potentially obstructing the drainpipe 23. The screen 25 is affixed to the end of drainpipe 23 by any conventional means known to those skilled in the art, including, for example, affixed by adhesive bonding, threading, frictional bonding or by mechanical engagement with a snap-ring (not illustrated). Screen 25 may also be integrally molded as part of drain pipe 23.

FIGS. 4(A–B) respectively shows cross-sectional and top plan views of another alternative embodiment of the top part of the present invention. In this embodiment, several finger holes 44 are formed within the surface of the grating 14'. A user inserts a finger into each of the finger holes 44 enabling the user to turn top part 12 about it longitudinal axis and thereby unlocking and removing the top part 12 from the bottom part 17.

The top part 12 further includes a plurality of channels 46 formed in radial proximity to the edge of the grating 14'. Each of the channels 46 is adapted for receiving a corresponding one of the channel bolts 50 shown in FIG. 4(C). Preferably, the channel bolts 50 are made of stainless steel or a similar corrosion-resistant metal or material. The channel bolts 50 are affixed to an inner lip 48 of the bottom part 17. The inner lip 48 is integrally formed within or affixed to the surface of the annular chamber 20 so that the inner lip 48 abuts edge of the grating 14' when the top part 12 is inserted within the annular chamber 20. The inner lip 48 functions to receive and secure the channel bolts 50. For instance, the channel bolts 50 may be screwed into lip openings 52 in the inner lip 48, frictionally engaged within the lip openings 52, integrally formed as part of the inner lip 48 or otherwise affixed in any manner that secures the channel bolts 50 to inner lip 48.

With continued reference to FIGS. 4(A–C), to lock the top part 12 within the bottom part 17, a user inserts the top part 12 into the annular chamber 20 of the bottom part 17. The grating 14' abuts the inner lip 48 and also so that each channel 46 engages a corresponding one of the channel bolts 50. The finger holes 44 are thereafter used to turn the top part 12 clockwise about its longitudinal axis to thereby frictionally engage each channel bolt 50 into locking engagement with an extremity of each channel 46. The top part 12 is unlocked from the bottom part 17 by reversing the aforementioned process. Thus, the finger holes 44 function to turn the top part 12 into locking or unlocking engagement with the bottom part 17 after the top part is inserted into the annular chamber 20 of the bottom part 17.

Referring collectively to FIGS. 1–4, the deck drain 10 is substantially made of non-metallic composite material that has a relatively high strain to failure rate or high elongation rate to thereby materially toughen deck drain 10 against routine operational wear and tear and against impact or stress-induced damage in shipboard emergency situations. Preferably, the top part 12 and the bottom part 17 are entirely made of a fiber-reinforced or glass-reinforced corrosion-resistant (e.g., hydrolotically and chemically stable), fire-retardant plastic material. In the preferred embodiment, 30–40% glass-reinforced thermoplastic Polyetherimide (PEI) is used to make the major parts of the deck drain 10, including the top part 12, the bottom part 17, and the stem 27 and the valve actuator 32 of the valve 26. Alternatively, however, the deck drain 10 may be made of any corrosion-resistant, fire-retardant composite material that has low smoke emission characteristics when burned. For instance, those skilled in the art will appreciate that the deck drain 10 may be made of any conventional thermoplastic or thermo-set plastic that meets the aforementioned functional criteria.

During fabrication, the components of the deck drain 10 are fastened together in a conventional manner. For instance, the deck grating 14 of FIG. 1(A) preferably is attached to the remainder of the top part 12 shown in FIG. 1(B) by spin-welding the parts together. The parts may also be case-molded. For instance, the bottom part 17 of FIG. 2 preferably is molded at relatively high temperature, and thereafter allowed to cool and set into the disclosed shape. Alternatively, components of the deck drain 10 may be fastened together by threading or by adhesives. For example, the drain nipple 24 of FIG. 2 may be threaded into the drainpipe 23, and the valve 26 may be mechanically affixed to the stem 27 by a cotter pin, snap ring or any similar fastener.

Once so fabricated, the deck drain 10 is typically installed on the underside of a deck. The term "underside" means the side or surface of the deck that opposes the side or surface that is exposed to the liquid that is intended to flow into deck drain assembly. For example, aboard the weather deck of a ship, the underside of the deck is the side of the deck that is not exposed to the weather and seas. Typically, the underside of the weather deck side forms the interior space of the ship. In this and other such operational environments, the deck drain 10 is fabricated so that the diameter of grating 14 is substantially the same diameter as the existing drain opening in the deck.

Preferably, the underside of the deck is prepared for installing the deck drain 10 by welding or otherwise affixing several threaded studs to the underside of the deck. The quantity and affixed location of the threaded studs are selected so as to facilitate mating the studs with the through openings 42 of the flange 40. The flange 40 is coated with a layer of adhesive sealant, for instance epoxy, polysulfide, polyurethane or methyl methacrylate adhesive. The flange 40 is then placed into parallel contact with the underside of the deck by passing each of the threaded studs through a corresponding one of the through openings 42 of the flange 40.

The flange 40 is manually pressed against the underside of the deck so that the adhesive coating bonds the flange 40 with the underside of the deck. The adhesive coating additionally acts to seal any small structural irregularities between the flange 40 and the underside of the deck. Installation of deck drain 10 is completed by mechanically fastening flange 40 to the underside of the deck by conventional corrosion-resistant flat washers and locknuts on each of the threaded studs. Thusly, the deck drain 10 is both adhesively and mechanically affixed to the underside of the deck and positioned so that the grating 14 fits within with the existing drain opening of the deck.

Referring again to FIGS. 1(A–B) and to FIG. 2, the present invention is used in the following manner. The deck drain 10 is installed so that wastewater and other liquids flow by gravity or channeling onto grating 14. The wastewater flows by gravity through through openings 35, baffles 36, perforations 21 of trap 16 and into annular chamber 20. In normal operations, valve 26 is disposed away from seating contact with the drainpipe 23, and wastewater accumulates in annular chamber 20 until it reaches a level sufficient to overflow into the drainpipe 23. The wastewater then flows by gravity through drain nipple 24 and into piping of the drainage system.

As disclosed supra, the through openings 35 and perforations 21 act to prevent, respectively, relatively large and small particulate matter from entering and potentially obstructing the drainpipe 23. Such small particulate matter, trapped by perforations 21, accumulates on trap 16. A user may periodically clean such small matter from the trap 16 by using handle 34 to turn top part 12 counterclockwise about its longitudinal axis, thereby unlocking the top part 12 from the bottom part 17. Top part 12 is then lifted and removed from the bottom part 17. The trap 16 is cleaned by manually scraping the small particulate matter from the perforations 21 and into a trash receptacle. The top part 12 is thereafter replaced back into the bottom part 17. The handle 34 is used to turn the top part 12 clockwise about its longitudinal axis, thereby locking the top part 12 and the bottom part 17 back together. Thus, by the present invention a user may conveniently clean accumulated small particulate matter from the trap 16 without using hand tools or complicated maintenance procedures.

In normal operation, drainpipe 23 is left open so that wastewater and other liquids can freely flow from the deck, through the grating 14, into to drain nipple 24 and drain into the piping of the drainage system. Typically, wastewater accumulates in the bottom of annular chamber 20 and forms a natural water trap that prevents sewer gases escaping from drainpipe 23 from escaping further out of deck drain 10 an onto the deck.

As disclosed supra, however, the valve actuator 32 is operable to turn the stem 27 and move valve 26 into seating contact with the drainpipe 23, thus physically preventing sewer gases and liquids from backflowing from the drainpipe 23 and drain nipple 24, through the grating 14 and onto the deck. Thus, the valve 26 may be used to close the drainpipe 23 and block the backflow of liquids and sewer gases out the drainpipe 23 and onto the deck.

It may also be advantageous to close the drainpipe 23 to prevent floodwater and fire combustion gases from backflowing out of the deck drain 10 onto the deck. For instance, in shipboard applications of the present invention, it is in emergency situations very desirable to be able to close the drainpipe 23 to prevent the spread of fire combustion gases or seawater flooding throughout the ship by way of the deck drains of the shipboard drainage system. The present invention enables the ship's crew to close the drainpipe of each installed deck drain 10, thereby effectively preventing the spread of fire combustion gases throughout the ship by the gases spreading through the drainage system. The present invention similarly enables the crew to prevent the spread of seawater flooding throughout the ship if grounding breaches the ship's interior hull or combat damage. In either case, the present invention markedly improves the ability of the ship to maintain watertight and firetight integrity, which in turn greatly increases the survivability of the ship in case of accidental or combat fire or flooding damage.

An advantage of present invention is that is easily assembled and disassembled for cleaning. As disclosed supra, by the handle 34 a user can easily unlock and remove the top part 12 from the bottom part 17. Thereafter, the user may clean accumulated small particulate matter from the perforations 21 of the trap 16. The trap 16 is easy to clean, particularly because the trap is removed from the bottom part 17 and therefore readily subject to visual inspection and manual handling. After cleaning, it is convenient and expeditious for a user to insert the top part 12 back into the annular chamber 20 of the bottom part 17 and use the handle 34 to lock the top and the bottom parts back together. The seal 38 functions to effectively prevent dirt and small particulate matter from entering and obstructing the tab receivers 22 and the tab grooves 28, further reducing the maintenance necessary to keep the deck drain 10 in good operating condition.

Another advantage of the present invention is that the top part 12 is securely locked within the bottom part 17 when the deck drain is reassembled after cleaning. Each of the locking tabs 18 of the top part 12 is readily engaged with a corresponding tab receiver 22 and tab groove 28 of the bottom part 17. By using the handle 34 to turn part 12 clockwise or counterclockwise about its longitudinal axis, a user can expeditiously and securely lock or unlock the top and the bottom parts of deck drain 10 together. This is accomplished without the need for special tools or need for the user to have knowledge of special operation or maintenance procedures.

Still another advantage of the present invention is that it is substantially made of composite plastic materials that resist the corrosive effects of the environment and damage by fire. As disclosed supra, the present invention is substantially fabricated of fiber or glass-reinforced resin materials. The resin materials resist corrosion, fire damage and are generally maintenance-free in terms of painting and lubrication. Fiber or glass-reinforced resin materials produce substantially less noxious combustion gases than equivalent metal alloy valves when accidentally ignited, such as accidentally ignited in a shipboard fire. Thus, by fabricating the present invention from fiber or glass-reinforced resin materials shipboard maintenance and fire hazards are considerably reduced.

A further advantage of the present invention is that it is easily affixed to the underside of a deck by using adhesive-sealants and mechanical fasteners, thus minimizing the need for welding and other such potentially dangerous processes to install the deck drain in the deck structure and restoring the deck surface treatment from welding damage. As disclosed supra, the flange 40 may be coated with adhesive and thereafter affixed to the underside of a deck by mating studs on the underside of the deck with corresponding through openings 42 of the flange and using flat washers and locknuts to secure the flange to the studs. The deck drain 10 is easily removable and replaceable by unscrewing the locknuts from the studs, and pulling the flange 40 free from adhesive contact with the underside of the deck. Thus, the deck drain 10 is conveniently removed from the underside of the deck, and, as necessary, maintained or replaced, without the need for welding or other potentially dangerous hot work.

There accordingly has been disclosed a deck drain 10 that includes a top part 12 and a bottom part 17. The top part 12 is manually removable from the bottom part 17 by a handle 34. A grating 14 is disposed at a first end of the top part 12, and a trap 16 is disposed at a second end of the top part 12. The trap 16 has perforations 21 for catching small particulate entrained in wastewater or other liquids entering by way of grating 14. The top part 12 further includes a plurality of locking tabs 18 affixed to the edge of a grating 14. The top part 12 fits within an annular chamber 20 of the bottom part 17. The bottom part 17 includes a plurality of tab receivers 22 suitable for receiving the locking tabs 18 of the top part 12. The top part 12 and the bottom part 17 are locked or unlocked from each other by using the handle 34 to turn the top part 12, thus engaging or disengaging the locking tabs 18 with the tab receivers 22 and within the tab grooves 28. The top part 12 further includes a valve 26, disposed within a bore 30. The valve 26 includes a valve actuator that is manually operable to close a drainpipe 23 of the bottom part 17. The bottom part 17 also includes a flange 40 that has a plurality of flange openings 42 formed therein to facilitate bolting and otherwise affixing the deck drain 10 to the underside of a deck. The present invention is substantially made of composite plastic material. The deck drain assembly of the present invention thus enables an untrained user to conveniently and expeditiously install, remove, maintain and replace the various parts disclosed supra. By use of fiber or glass-reinforced resin fabrication materials, the present invention considerably reduces the frequency and scope of maintenance and care necessary to maintain the deck drain assembly in good working condition. The valve assembly of the present invention enables a user to conveniently close the drainpipe, thus preventing sewer gases, wastewater, waste liquids, floodwater, chemicals, flammable liquids, gases and fire combustion gases from accidentally backflowing from the drainage system, out of the deck drain and onto the deck.

In this disclosure, there is shown and described only the preferred embodiment of the invention, but as aforementioned, it is to be understood that the invention is capable of use in various other combinations and environments and is capable of changes or modifications within the scope of the inventive concept expressed herein.

Obviously, other modifications and variations of the present invention may be possible in light of the foregoing teachings. It is therefore to be understood that within the scope of the appended claims the invention may be practiced otherwise than as specifically described.

What is claimed is:

1. A drain suitable for draining liquid from a deck, the drain comprising:

a top part having axially opposed ends, a grating disposed at a first end of said top part and having an edge receiving liquid into the drain, a trap disposed at a second end of said top part catching debris entrained in the liquid, a plurality of circumferentially spaced locking tabs about said edge of said grating, a bottom part enclosing an annular chamber receiving said top part therein, a plurality of tab receivers formed within said top part engaged with said locking tabs to lock said top part within said annular chamber of said bottom part, a drainpipe affixed to said bottom part through which liquid is drained from said annular chamber and out of said drain, a valve disposed within said top part to close said drainpipe and prevent liquid from flowing in or out of said drain, and a liquid seal formed between a baffle of the top part and the drain pipe of the bottom part that prevents the venting of waste gases.

2. The drain of claim 1, wherein each of said tab receivers includes tab grooves within which said tabs are received to accommodate locking of said top part to said bottom part by turning of said locking tabs about the longitudinal axis of said top part.

3. The drain of claim 1, wherein a bore is formed in the top part within which said valve is threadedly engaged.

4. The drain of claim 1, wherein said valve includes a valve actuator substantially disposed within said top part and manually operable to close said drainpipe.

5. The drain of claim 1, including: handle or finger hole means within the grating for manually removing said top part from said bottom part.

6. The drain of claim 5, wherein said top part further includes a baffled opening through which liquid is channeled into said trap.

7. The drain of claim 1, wherein said top part further includes at least one seal preventing escape of waste gases from the drain when said bottom part and said top part are locked together.

8. The drain of claim 1, wherein said bottom part further includes a flange through which said drain is attached to the deck.

9. The drain of claim 8, wherein a plurality of flange openings are formed in the flange through which said drain is attached to the deck by bolting.

10. The drain of claim 8, wherein said flange is affixed to the deck by an adhesive.

11. The drain of claim 10, wherein the adhesive is selected from the group consisting of epoxy, polysulfide, polyurethane and methyl methacrylate adhesives.

12. The drain of claim 10, wherein the adhesive is an adhesive sealant.

13. The drain of claim 1, wherein said drain is substantially made of composite plastic materials to resist corrosion.

14. A drain suitable for draining liquid from a deck comprising:

a top part having axially opposite upper and lower ends, a grating disposed at the upper end of said top part receiving the liquid into a drain;

a trap disposed at the lower end of said top part catching debris entrained in the liquid;

a bottom part enclosing an annular chamber within which said top part is positioned and locked to the top part;

a drainpipe affixed to said bottom part through which the liquid from said annular chamber undergoes drainage; and a valve selectively positioned within said top part to prevent said drainage of the liquid from the drain, including: locking tabs and tab grooves through which said top part is locked to said bottom part by turning of said tabs within said tab grooves about a longitudinal axis of said top part.

15. The drain as defined in claim 14, wherein said top part further includes a bore formed within the top part within which the valve is threadably positioned.

16. The drain of claim 14, wherein said valve has a valve actuator substantially disposed within said grating and manually operable to close said drainpipe.

17. The drain as defined in claim 14, including: handle or finger hole means within the grating for manually removing said top part from said bottom part.

18. The drain of claim 17, wherein said grating has a baffled opening through which the liquid is channeled into said trap.

19. The drain as defined in claim 14, including: a seal disposed on said top part to prevent the escape of waste gases from the drain when said bottom part and said top part are locked together.

20. The drain as defined in claim 14, including: a flange on the bottom part attached to said deck.

21. The drain as defined in claim 20, wherein said flange has a plurality of flange openings formed therein through which the bottom part is attached to the deck by bolting.

22. The drain as defined in claim 20, wherein said flange is affixed by adhesive to the deck.

23. The drain as defined in claim 22, wherein the adhesive is selected from the group consisting of epoxy, polysulfide, polyurethane and methyl methacrylate adhesives.

24. The drain of claim 22, wherein the adhesive is an adhesive sealant.

25. The drain as defined in claim 14, wherein said drain is substantially made of composite plastic materials to resist corrosion.

* * * * *